US006550289B1

(12) United States Patent
Higgins

(10) Patent No.: US 6,550,289 B1
(45) Date of Patent: Apr. 22, 2003

(54) DOUBLE-LAYER SOCK HAVING INVERTED, SIDE-BY-SIDE TOE CLOSURE SEAMS

(75) Inventor: David B. Higgins, Newton, NC (US)

(73) Assignee: Knit-Rite, Inc., Kansas City, KS (US)

( * ) Notice: Subject to any disclaimer, the term of this patent is extended or adjusted under 35 U.S.C. 154(b) by 250 days.

(21) Appl. No.: 09/707,265

(22) Filed: Nov. 6, 2000

(51) Int. Cl.[7] ..... D04B 9/46; A41B 11/00
(52) U.S. Cl. ..... 66/179; 66/182; 2/239
(58) Field of Search ..... 66/179, 178 R, 66/180, 181, 182, 183, 185; 2/239, 240, 241, 242

(56) References Cited

U.S. PATENT DOCUMENTS

| | | | | |
|---|---|---|---|---|
| 294,020 | A | | 2/1884 | Eisendrath |
| 379,831 | A | | 3/1888 | Sutro |
| 2,263,763 | A | | 11/1941 | Edwards |
| 2,433,834 | A | | 1/1948 | Bazett et al. |
| 2,633,446 | A | | 3/1953 | King |
| 3,259,915 | A | | 7/1966 | Dison |
| 3,307,379 | A | | 3/1967 | Woolley et al. |
| 3,510,882 | A | | 5/1970 | White |
| 3,796,067 | A | | 3/1974 | East |
| 4,341,096 | A | | 7/1982 | Safrit et al. |
| 4,373,215 | A | | 2/1983 | Guigley |
| 4,373,361 | A | | 2/1983 | Thorneburg |
| 4,467,626 | A | | 8/1984 | Coble et al. |
| 4,571,960 | A | | 2/1986 | Hursh et al. |
| 4,615,188 | A | | 10/1986 | Hursh et al. |
| 4,843,844 | A | | 7/1989 | Hursh et al. |
| 4,870,708 | A | * | 10/1989 | Staley ..... 2/404 |
| 5,095,548 | A | | 3/1992 | Chesebro, Jr. |
| 5,226,194 | A | | 7/1993 | Staley |
| 5,319,807 | A | | 6/1994 | Brier |
| 5,353,524 | A | | 10/1994 | Brier |
| 5,402,540 | A | | 4/1995 | Williams |
| 5,416,929 | A | | 5/1995 | Braunstein |
| 5,453,268 | A | | 9/1995 | Ueno et al. |
| 5,590,420 | A | | 1/1997 | Gunn |
| 5,615,418 | A | | 4/1997 | Pruit |
| 5,675,992 | A | | 10/1997 | Wrightenberry |
| 5,778,702 | A | | 7/1998 | Wrightenberry |
| 5,832,539 | A | | 11/1998 | Williams |
| 6,108,820 | A1 | | 8/2002 | Bernhardt |

FOREIGN PATENT DOCUMENTS

| | | |
|---|---|---|
| FR | 722958 | 3/1932 |
| FR | 2454766 | 12/1990 |

* cited by examiner

*Primary Examiner*—Danny Worrell
(74) *Attorney, Agent, or Firm*—Hovey Williams LLP

(57) ABSTRACT

A double-layer sock includes substantially coextensive, separately knitted inner and outer layers that cooperatively form a fabric receptacle dimensioned to fit over the foot and at least a portion of the leg of the wearer. The separately knitted inner and outer fabric layers are joined by sewn attachment stitches. The attachment stitches include stitching extending completely around the open leg end of the receptacle and tack stitching located within the toe sections of the layers. The layers are each preferably knit in a manner, such as by a circular knitting machine, requiring toe closure seams. The toe closure seams face toward one another in a juxtaposed relationship, such that the rib presented by each seam is overlain and concealed by the opposite fabric layer. The outer layer preferably presents inwardly facing terry loops so as to further minimize bulging created by the closure seams. A form for facilitating fabrication of a double-layer sock is also disclosed.

29 Claims, 2 Drawing Sheets

DOUBLE-LAYER SOCK HAVING INVERTED, SIDE-BY-SIDE TOE CLOSURE SEAMS

BACKGROUND OF THE INVENTION

1. Field of the Invention

The present invention relates generally to hosiery and, more particularly, to a multiple-layer sock and the method for making same. The sock preferably includes separately knitted inner and outer fabric layers that are attached along the top leg opening and at discrete locations adjacent the toe end. In addition, one of the layers preferably includes a closure seam that is oriented toward and overlain by the other fabric layer. The present invention also particularly concerns a form used in constructing the double-layer sock.

2. Discussion of Prior Art

Although multiple-layer socks have been developed for various applications, they are often problematic and, in some instances, harmful to the wearer. For example, the layers of conventional socks will often fail to remain in proper alignment and will consequently bunch up, causing discomfort and areas of focal pressure. Those ordinarily skilled in the art will appreciate that areas of focal pressure are particularly troublesome for persons having peripheral neuropathy (e.g., a person with diabetes), as such areas can go unnoticed and thereby cause skin sores. As is also customary, one or both of the layers of a conventional multilayered sock will have a toe closure seam that presents a hard, projecting rib, which can similarly create an area of focal pressure. This is particularly problematic with double-layer socks having a common toe closure seam for both layers, wherein four edges of material are brought together to form the seam. It is also noted that the production of multilayered socks has historically been expensive, complex and time consuming.

OBJECTS AND SUMMARY OF THE INVENTION

Responsive to these and other problems, an important object of the present invention is to provide a multilayered sock that is effective in its intended application. It is also an important object of the present invention to provide a multilayered sock that reduces the risk of bunching of the fabric. Additionally, an important object of the present invention is to provide a multilayered sock that is unlikely to create areas of focal pressure when worn. It is specifically an important object of the present invention to provide a multilayered sock for persons having peripheral neuropathy. Another important object of the present invention is to provide a multilayered sock having an inexpensive, simple and durable construction. Yet another important object of the present invention is to provide a system for making multilayered socks having relatively low production costs, time and complexity.

In accordance with these and other objects evident from the following description of the preferred embodiment, the present invention concerns a sock comprising a multilayered fabric receptacle dimensioned to fit over the foot and at least a portion of the leg of the wearer. The receptacle includes an inner layer and an outer layer, with at least one of the layers having a sewn closure seam that presents a rib oriented toward and overlain by the other layer. The rib is consequently concealed by the other layer, and the other layer naturally pads against focal pressure that might otherwise be created by the rib. Further, this arrangement prevents the rib from facing outwardly toward footwear or inwardly into contact with the skin, which is believed to further reduce the risk of discomfort and injury. The present invention also concerns the method making a sock having the inverted closure seam.

Another aspect of the present invention concerns a sock comprising a multilayered fabric receptacle dimensioned to fit over the foot and at least a portion of the leg of the wearer. The receptacle presents a top, open leg end and an opposite toe end. Further, the receptacle includes substantially coextensive, separately knitted inner and outer layers. The fabric layers present generally superimposed toe sections adjacent the toe end of the receptacle and dimensioned to fit over the toes of the wearer, generally superimposed leg sections adjacent the leg end of the receptacle and dimensioned to fit over at least a portion of the leg of the wearer, and generally superimposed foot sections each extending between the respective leg and toe sections. The fabric layers are joined along the top end of the receptacle and at a location within the toe sections of the fabric layers. It has been determined that such joining of the layers is highly effective in maintaining proper alignment and superimposition of the layers during use. In addition, the counterintuitive use of separately knitted layers actually reduces production costs and provides significant flexibility in sock construction. The present invention further involves the method of making a sock having separately knitted inner and outer layers joined in the manner just described.

The present invention also concerns a form used in fabricating a multiple-layer sock having an inner layer and an outer layer. The form includes an inner layer pattern configured to receive the inner layer of the sock thereon and an outer layer pattern configured to receive the outer layer of the sock thereon. The patterns are arranged and configured so that the inner and outer layers of the sock are superimposed when received on the patterns. An inventive method of using the form to fabricate a multiple-layer sock is also claimed.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

Figure 8:
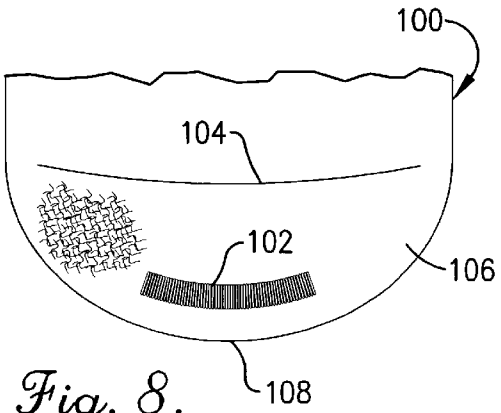
Figure 9:
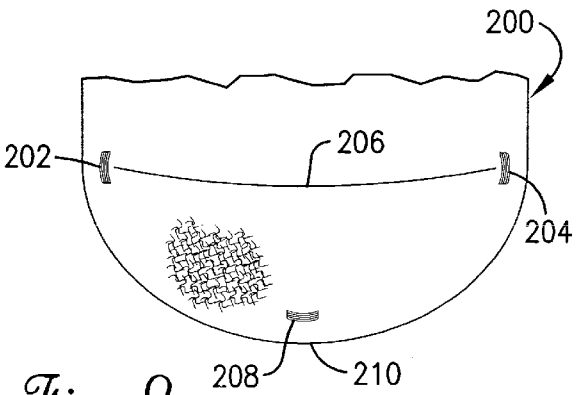

FIG. 8 is a fragmentary, top elevational view of a second embodiment of the present invention, wherein the inner and outer layers of the sock are attached adjacent the toe end by sewn attachment stitching extending parallel to the toe end; and FIG. 9 is a fragmentary, top elevation view of a third embodiment of the present invention, wherein the inner and outer layers of the sock are attached adjacent the toe end by sewn attachment stitching adjacent the toe end and at opposite ends of the closure seam of the outer layer.

DETAILED DESCRIPTION OF THE PREFERRED EMBODIMENT

Figures 1, 2, 3, 4, 5:
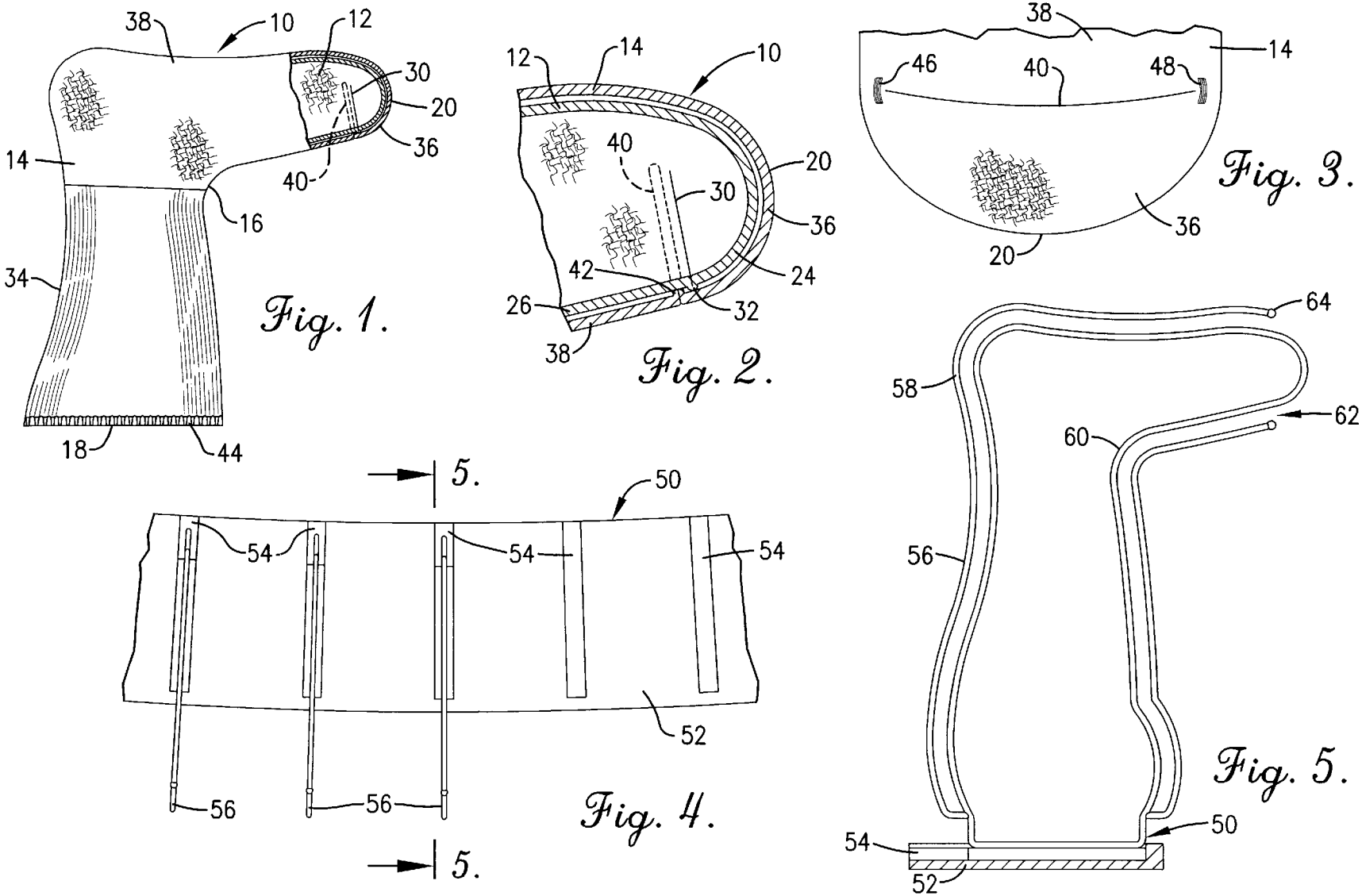
FIG. 1 is a side elevational view of a sock constructed in accordance with the principles of the present invention, wherein portions of the toe and foot sections of the outer layer of the sock have been removed to reveal the inverted, side-by-side arrangement of the closure seams.
FIG. 2 is an enlarged, fragmentary side elevational view of the sock adjacent the toe end, with portions of the outer layer being removed similar to FIG. 1.
FIG. 3 is an enlarged, fragmentary top elevational view of the sock adjacent the toe end, particularly illustrating the sewn attachment stitches at opposite ends of the closure seam of the outer layer.
FIG. 4 is a fragmentary top elevational view of a form constructed in accordance with the principles of the present invention and used in fabricating the sock shown in FIGS. 1–3.
FIG. 5 is a vertical cross-sectional view of the form taken along line 5—5 of FIG. 4.

Turning initially to FIG. 1, the sock 10 selected for illustration includes an inner layer 12 and an outer layer 14 cooperatively forming a double-layer fabric receptacle 16 dimensioned to fit over the foot and at least a portion of the leg of the wearer (not shown). Although the sock 10 preferably includes only two fabric layers 12 and 14, the principles of the present invention are equally applicable to a sock having additional fabric layers between the inner and outer layers. It is also noted that the illustrated fabric layers 12 and 14 are generally coextensive (e.g., compare FIGS. 6 and 7); however, the scope of the present invention encompasses fabric layers that are not substantially coextensive (e.g., portions of the receptacle may be defined by only one layer, while other portions are defined by multiple layers).

The receptacle 16 presents an top, open leg end 18 through which the foot and corresponding part of leg are inserted when the sock 10 is donned. The illustrated receptacle 16 further includes a closed toe end 20 opposite from the leg end 18. However, with respect to several aspects of the present invention, an opening may alternatively be provided at the toe end 20.

The layers 12 and 14 are preferably formed of fabric and, most preferably, knitted separately. In other words, the illustrated layers 12 and 14 are not both formed by a single, continuous knitting process (e.g., knitted on a circular knitting bed) so as to be integrally joined, whereby the receptacle would likely be formed by folding the fabric and inserting the inner layer into the outer layer. Although such an alternative construction is encompassed by several aspects of the present invention, the separately knitted layers 12 and 14 are most preferred because of the advantages provided thereby. Contrary to common beliefs, it has been determined that the use of separately knitted layers actually reduces the overall production costs of manufacturing multilayered socks. Specifically, if one of the layers is damaged during production, only it needs to be discarded or identified as "second quality" or as an "irregular." It is also possible to sell the layers individually as single layer socks, thereby reducing inventory costs and management. Further, higher cost materials or constructions can be limited to one layer to minimize costs without sacrificing the desired benefits. The preferred use of separately knitted layers also provides virtually unlimited design flexibility. For example, the preferred fabric layers 12 and 14 maybe manufactured on two completely different types of equipment (e.g., circular knitting machine, flatbed knitting machine, etc.). It is also possible to manufacture the layers so as to have significantly different characteristics.

For purposes of clarity, the term "separately knitted" or "separately knitting" as used herein shall be understood to mean individually forming the layers using any suitable knitting technique. That is to say, this term shall be interpreted to mean knitting of the layers so that they are not integrally formed but rather must be attached in some way to form the unitary receptacle. It may further be said that this term does not encompass continuously knitting both layers in a single, non-interrupted process (e.g., sequential, continuous knitting of the layers on the same machine). It will be appreciated, however, that the term does encompass identically constructed layers (e.g., layers knit on the same machine, one after the other, as long as there is a sufficient "stoppage" in the knitting process that the layers are joined in the desired manner).

Figure 7:
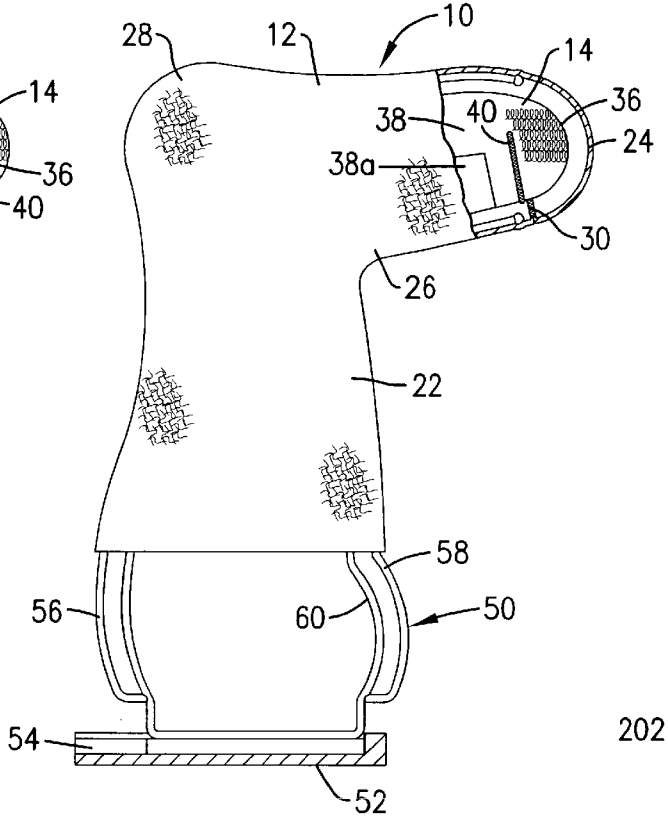
FIG. 7 is a vertical cross-sectional view of the form similar to FIG. 6, but illustrating the inner fabric layer placed on the form over the outer layer.

As perhaps best shown in FIG. 7, the illustrated inner layer 14 includes a leg section 22 adjacent the leg end 18 of the receptacle 16, a toe section 24 adjacent the toe end 20 of the receptacle, and a foot section 26 extending between the leg and toe sections 22 and 24. The inner layer 12 is preferably slightly smaller than the outer layer 14 so that the risk of the inner layer 12 bunching is minimized.

The leg section 22 is tubular and dimensioned to fit over a portion of the leg extending up into the calf area, although the principles of the present invention are equally applicable to a relatively shorter leg section (e.g., a leg section that terminates just above the ankle). The leg section 22 terminates at the leg end 18 and extends downwardly therefrom to join the foot section 26. Any suitable technique (e.g., a heat fusing yam, a hem, etc.) may be used at the leg end 18 to protect and prevent unraveling of the leg section 22, although such protection in the preferred embodiment is provided by the manner in which the inner and outer layers 12 and 14 are joined.

The foot section 26 of the inner layer 12 is dimensioned to fit over the foot of the wearer and extends generally from the heal to the toes. The foot section 26 is generally tubular to completely overlie the underlying portion of the foot, although the leg and foot sections 22 and 26 may be provided with one or more openings (not shown) so as to expose portions of the outer layer 14 to the body. The foot section 26 preferably includes a heel pocket 28 formed by any suitable technique (e.g., full fashioning stitching); however, it is entirely within the ambit of the present invention to configure the foot section 26 as a straight tube without an extended pocket.

The toe section 24 preferably tapers toward the toe end 20 and is completely closed, although an opening (not shown) may be provided as previously indicated. The taper of the toe section 24 may be provided by any suitable technique (e.g., full fashioning stitching). The present invention also contemplates the use of one or more individual toe pockets (not shown), each configured to receive a corresponding one of the toes of the wearer. Moreover, a closure seam 30 is provided in the toe section 24, as the illustrated inner layer 12 is formed by a process (e.g., knitted on a circular knitting bed) that leaves an opening adjacent the toe end 20. It may be said that the closure seam 30 defines the upper margin of the toe section 24.

With particular respect to the closure seam 30, the opposite fabric edges forming the opening in the inner layer 12 are in the usual manner brought together and slightly superimposed (see FIG. 2). The edges are then sewn together by any suitable yarn (similar or different to that used in the knitting process). Those ordinarily skilled in the art will appreciate that the standard technique of forming the seam 30 involves sewing the seam 30 after and typically separate from knitting of the layer 12; that is, knitting of the inner layer 12 and sewing of the seam 30 are two separate processes. Furthermore, the seam presents an outwardly projecting rib 32, which is primarily attributable to the fact that the fabric edges are folded against one another. The illustrated closure seam 30 is a so-called "standard toe closure" extending laterally across the top of the toe section 24. However, it is entirely within the ambit of the present invention to utilize other types of closure seams (e.g., a so-called "fish mouth toe closure"). It is also possible to eliminate the closure seam 30 entirely, with such an alternative inner layer being seamless. Such a seamless construction is disclosed in application for U.S. Ser. No. 09/397,421, filed Sep. 17, 1999, entitled SEAMLESS, FORM FITTING FOOT SOCK, assigned of record to the Assignee of the present invention, and hereby incorporated by reference herein as is necessary for a full and complete understanding of the present invention. It is particularly noted with respect to several aspects of the present invention that one or both layers 12 and 14 maybe seamless.

The sections 24,26,28 of the inner layer 12 are preferably formed by a continuous knitting process so as to be integrally joined. With particular respect to therapeutic applications, the inner layer 12 is preferably formed on fine gauge machinery having a relatively high needle count, thereby providing a smooth, soft hand. The inner layer 12 is also preferably formed of white, totally undyed fabrics so as to be innocuous to persons allergic or sensitive to dying agents. Yet further, the preferred inner layer 12 includes moisture transporting and antimicrobial fibers. It is also desirable to knit the inner layer 12 of a highly elastic material (e.g., corespun spandex), which is believed to minimize the risk of wrinkles in the layer 12. Generally speaking, the inner layer 12 is preferably designed with an emphasis on comfort and protection because of its direct contact with the skin.

Figure 6:
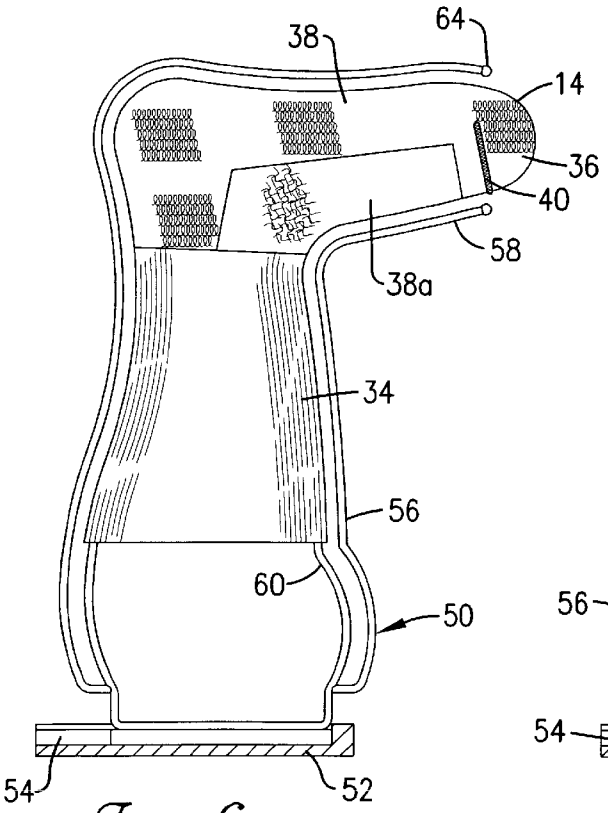
FIG. 6 is a vertical cross-sectional view of the form similar to FIG. 5, but illustrating the outer fabric layer of the sock located on the form.

Similar to the inner layer 12, the outer layer 14 includes a leg section 34, a toe section 36, and a foot section 38 (e.g., see FIG. 6). It is again initially noted that the preferred layers 12 and 14 are substantially coextensive and superimposed. In this regard, the leg section 34 of the outer layer 14 generally overlies the leg section 22 of the inner layer, the foot section 38 of the outer layer 14 generally overlies the foot section 26 of the inner layer 12, and the toe section 36 of the outer layer 14 generally overlies the toe section 24 of the inner layer 12. Furthermore, the sections 34,36,38 of the illustrated outer layer 14 are each preferably similar to the underlying, corresponding one of the sections 22,24,26 of the inner layer 12. Thus, the layers 12 and 14 are preferably altered or modified from the illustrated configurations in the same manner. For example, if the inner layer alternatively included a toe section formed by individual toe pockets, the outer layer would preferably also be altered to include similar overlying toe pockets. It will be appreciated, however, that certain aspects of the present invention contemplate differently configured inner and outer layers (e.g., a seamless inner layer and an outer layer having a closure seam, inner and outer layers that are not substantially coextensive, etc.).

In view of the foregoing, it shall be sufficient to describe that the illustrated outer layer 14 includes a closure seam 40 in the toe section 36. Similar to the seam 30 of the inner layer 12, the seam 40 comprises a so-called "standard toe closure" and consequently presents a projecting, relatively hard rib 42 (see FIG. 2). Further, the illustrated seam 40 extends laterally across the top of the toe section 36 (see FIG. 3). The outer layer 14 preferably has different characteristics than the inner layer 12, with an emphasis being placed on fashion, durability and comfort. The preferred outer layer 14 is consequently knitted on heavy gauge machinery having a lower needle count. In addition, the outer layer 14 is preferably formed of a heavier yarn or material (e.g., wool) than the inner layer, thereby providing greater padding, thickness and durability. Suitable elastic material may be provided in the all or some of the sections of the outer layer 14. It is also preferred, in some cases, to dye the outer layer for fashion purposes (e.g., color coordination purposes), although an entirely white, undyed sock is encompassed by the spirit of the present invention. Similar to the inner layer 12, the outer layer 14 is preferably formed by a continuous knitting process (e.g., knitted on a circular knitting bed so as to require the closure seam 40). However, the knitting pattern of the illustrated outer layer 14 varies from section to section, as is customary for a majority of standard socks. In particular, the leg section 34 of the outer layer 14 is preferably formed of rib-type knitting pattern. The toe and foot sections 36 and 38 are preferably formed of a plain or flat knitting pattern, although the knitting pattern of an upper region 38*a* of the foot section 38 maybe varied slightly as illustrated in FIG. 6.

Because the illustrated layers 12 and 14 are separately knitted, the unitary receptacle 16 is formed by joining the layers. It is believed that an inventive manner in which to join the layers 12 and 14 involves attachment at the leg end 18 and at a location within the toe sections 24 and 36. In the illustrated embodiment, the fabric layers 12 and 14 are joined by stitching 44 extending completely around the open leg end 18, although it is entirely within the ambit of the present invention to provide stitching along only part of the leg end (e.g., circumferentially spaced apart stitching lines). The stitching 44 is preferably sewn and, most preferably, comprises blind or overlap stitching (e.g., surge or overlock stitches) so as not to inhibit the desired elasticity of the sock 10. The stitching 44 consequently joins the layers 12 and 14 completely about their top ends and further serves to protect the end from unraveling, running, etc. The attachment of the layers 12 and 14 in the toe sections 24,36 most preferably comprises two discrete tack stitchings 46 and 48. In the embodiment shown in FIGS. 1–3, the tack stitchings 46 and 48 are located adjacent opposite ends of the closure seam 40. The stitchings 46 and 48 are each preferably sewn by any suitable means (e.g., a button sewing machine). As will subsequently be described, the joinder of the layers 12 and 14 in the toe sections 24,36 may be varied without departing from the spirit of the present invention. It has been determined that the inventive manner in which the layers 12 and 14 are attached provides numerous advantages. For example, the stitchings 44,46,48 virtually prevent misalignment of the layers 12 and 14 (i.e., each of the sections 34,36,38 of the outer layer 14 are maintained in the desired overlying relationship with the corresponding one of the sections 22,24,26 of the inner layer 12) without creating bulky seams or bulges that might cause undesirable areas of focal pressure.

As perhaps best shown in FIG. 2, the superimposed layers 12 and 14 define an internal, somewhat annular, closed cavity therebetween. The closure seams 30 and 40 are preferably both oriented so that the ribs 32 and 42 defined thereby project inwardly into the cavity. Accordingly, the relatively smooth underside of each sewn seam 30 and 40 is exposed—the underside of the seam 30 facing the wearer and the underside of the seam 40 facing any footwear. The inverted orientation of the seams 30 and 40 is believed to significantly minimize the focal pressure that might otherwise by created when the sock 10 is worn. This is believed to be primarily attributable to the fact that each of the ribs 30 and 42 is overlain by a respective one of the fabric layers 14 and 12. To even further avoid the problems associated with focal pressure, the seams 30 and 40 are also preferably offset relative to one another. It is noted that the illustrated seams 30 and 40 are elongated and extend laterally across the top of the respective one of the toe sections 24 and 36. Furthermore, the illustrated layers 12 and 14 are dimensioned and configured so that the closure seams 30 and 40 extend immediately alongside one another in a juxtaposed relationship. Because the seams 30 and 40 are similar in shape and size, it is believed that they will naturally be maintained in the desired side-by-side relationship. However, undesirable alignment or superimposition of the seams 30 and 40 may further be avoided by forming one of the seams as a so-called "standard toe closure" and the other as a so-called "fishmouth toe closure." Although shown only schematically in FIG. 6, it will be appreciated that the illustrated outer layer 14 is knitted in a manner to present terry loops along the internal surface thereof (i.e., the surface facing the inner layer 12). This is believed to provide padding that "fills" in around the seams 30 and 40 and thereby minimize focal pressures. The interior surface of the upper region 38*a* of the foot section 38 preferably does not include terry loops to minimize thickness in this area. Of course, the use of a relatively heavy yam in knitting the outer layer 14 will have an effect similar to the terry loops.

As noted above the sock 10 is preferably formed by knitting the layers 12 and 14 separately. The layers 12 and 14 are properly aligned and superimposed and preferably then joined by the stitchings 44,46,48.

With respect to the step of aligning and superimposing the layers 12 and 14, the manufacturing method preferably involves the use of an inventive form 50. The illustrated form 50 includes a base 52 having a plurality of slots 54 defined therein. The form 50 further preferably includes a plurality of frames 56, each being removably retained within a respective one of the slots 52. Each of the frames 56 is dimensioned to correspond with a specific sock size. As perhaps best shown in FIG. 5, the frame 56 is preferably formed of an unitary wire body to present an inner layer pattern 58 and an outer layer pattern 60. The inner layer pattern 58 is preferably spaced outwardly from the outer layer pattern 60, for purposes which will be described. Each of the patterns 58 and 60 is in the shape of the respective one of the layers 12 and 14. The outermost pattern (i.e., the inner layer pattern 58 in the illustrated embodiment) includes an opening 62 defined at the toe end thereof. The opening 62 permits the outer layer 14 to be placed onto the pattern 60. The wire ends of the inner layer pattern 58 are provided with bulbous protective caps 64 that serve to reduce the risk of snagging when the inner layer 12 is placed on the pattern 58. Although the outer layer pattern 60 is illustrated as a continuous wire element, the principles of the present invention are equally applicable to an alternative outer layer pattern that similarly includes one or more openings.

The use of the form 50 involves first placing the knitted outer layer 14 on the pattern 60. This is accomplished by putting the open leg end of the layer 14 on the toe end of the pattern 60 and sliding the layer 14 over the pattern. Again, the opening 62 in the inner layer pattern 58 permits the outer layer 14 to be placed on the pattern 60. The closure seam 40 has preferably already been sewn by this point, and the layer 14 may therefore be drawn taut onto the pattern 60. Of course, the principles of the present invention are equally applicable to alternatively sewing the seam 40 while the outer layer 14 is supported on the pattern 60. Moreover, the outer layer 14 is placed on the pattern 60 in an inverted condition so that the rib 42 formed by the seam 40 faces outwardly.

The inner layer 12 is then placed on the pattern 58. It will be appreciated that the layer 12 must be stretched considerably to place the leg opening over the ends of the pattern 58. Snagging of the material during this step is prevented by the ball-like caps 64. Similar to the outer layer 14, the closure seam 30 of the inner layer 12 is preferably sewn before the form 50 is used, and the inner layer 12 may therefore be drawn taut onto the pattern 58. Because of the relatively smaller size of the inner layer 12 but relatively larger size of the inner layer pattern 58, the inner layer 12 will be stretched significantly more than the outer layer 14 during use of the form 50. Moreover, the inner layer 12 is placed on the form so that the rib 32 formed by the seam 40 faces inwardly toward the outer layer 14.

The layers 12 and 14 are then removed from the frame 56. This is preferably accomplished by holding or pinching the layers adjacent the top of the leg sections 22,34 and at the toe sections 24,36 while sliding the layers 12,14 off the patterns 58,60. Sewing of the attachment stitching 44,46,48 preferably then occurs to join the layers 12 and 14, although alternatively sewing the attachment stitching 44,46,48 while the layers 12 and 14 are supported on the patterns 58 and 60 is encompassed by the present invention. It will be appreciated that the inner layer 12 is situated exteriorly in the preferred embodiment so that it can readily be inspected once the layers 12 and 14 are removed from the frame 56. Particularly, it is desirable to ensure that the inner layer 12 is not oversized relative to the outer layer 14; otherwise, bunching of the inner layer is likely. After inspection, the unitary receptacle 16 is then pulled inside out so that the inner and outer layers 12 and 14 are properly oriented. The ribs 32,42 of the seams 30,40 are likely in the desired offset, side-by-side relationship when the receptacle 16 is reversed but will nonetheless naturally move into this condition as indicated above.

It is again noted that various modifications and alterations maybe made to the illustrated embodiment without departing from the scope of the present invention. For example, if the sock includes more than two layers, a common seam may be provided for two or more of the layers, although a separate closure seam for each layer is most preferred. The separate toe closure seam for each layer needing reduces the number of fabric edges in each seam (e.g., two as opposed to four), thereby further minimizing bulk of the fabric layer.

Variations of the attachment stitching may also be made. Such alternative embodiments are shown in FIGS. 8 and 9. Turning first to FIG. 8, a sock 100 includes an elongated sewn stitching row 102 located between the closure seam 104 of the outer layer 106 and the toe end 108. The stitching row 102 extends laterally in a generally parallel relationship with the toe end 108. FIG. 9 shows a sock 200 having discrete tack stitchings 202 and 204 adjacent opposite ends of the closure seam 206, similar to the embodiment shown in FIGS. 1–3. However, another discrete tack stitching 208 is provided adjacent the toe end 210 at a location spaced centrally between the stitchings 202 and 204.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A sock comprising:

a multilayered fabric receptacle dimensioned to fit over the foot and at least a portion of the leg of the wearer, said receptacle including an inner layer and an outer layer, at least one of the layers having a sewn closure seam that presents a rib oriented toward and overlain by the other layer, said other layer having a sewn closure seam that presents a rib oriented toward and overlain by said at least one of the layers, whereby each of the layers has a respective one of the closure seams, said receptacle presenting an upper, open leg end and an opposite toe end, said closure seams each being elongated and adjacent the toe end, with the ribs presented by the seams being offset relative to one another.

2. A sock as claimed in claim 1, said layers being substantially coextensive.

3. A sock as claimed in claim 2, said toe end being closed.

4. A sock as claimed in claim 3, said inner and outer layers presenting generally superimposed toe sections adjacent the toe end of the receptacle and dimensioned to fit over the toes of the wearer, generally superimposed leg sections adjacent the leg end of the receptacle and dimensioned to fit over at least a portion of the leg of the wearer, and generally superimposed foot sections each extending between the respective leg and toe sections, said closure seams being located in the toe sections.

5. A sock as claimed in claim 1, said other layer including a section that overlies the closure seam of said at least one of the layers, said section being knitted to present terry loops that are oriented toward the rib of the closure seam of said at least one of the layers.

6. A sock comprising:

a multilayered fabric receptacle dimensioned to fit over the foot and at least a portion of the leg of the wearer, said receptacle including an inner layer and an outer layer, at least one of the layers having a sewn closure seam that presents a rib oriented toward and overlain by the other layer, said layers being formed of separately knitted fabric elements and being joined by sewn attachment stitches, said receptacle presenting an upper, open leg end and an opposite, closed toe end, said closure seam being located adjacent the toe end, said attachment stitches including a top stitching extending about the leg end and tack stitching adjacent the toe end.

7. A method of making a sock comprising a multilayered fabric receptacle dimensioned to fit over the foot and at least a portion of the leg of the wearer, said method comprising the steps of:

(a) knitting an inner fabric layer of the receptacle;

(b) knitting an outer fabric layer of the receptacle;

(c) sewing an opening in one of the fabric layers closed so as to present a closure seam in the one fabric layer;

(d) orienting the rib presented by the closure seam toward the other layer so that the rib is overlain and concealed by the other layer, steps (a) and (b) occurring separately; and (e) joining the inner and outer layers with attachment stitches, step (e) including the steps of sewing attachment stitching around the open leg end of the receptacle and sewing attachment stitching adjacent the toe end of the receptacle.

8. A method as claimed in claim 7, one of said steps (a) and (b) including the step of knitting the other layer to present terry loops; and (f) orienting the terry loops of the other layer toward the rib of the closure seam.

9. A method as claimed in claim 7, steps (a) and (b) each including the steps of knitting a toe section adjacent the toe end of the receptacle, wherein the toe section is dimensioned to fit over the toes of the wearer, knitting a leg section adjacent the leg end of the receptacle, wherein the leg section is dimensioned to fit over at least a portion of the leg of the wearer, and knitting a foot section that extends between the leg and toe sections.

10. A method as claimed in claim 9, said steps of knitting the toe, foot and leg sections of each layer being performed continuously.

11. A method of making a sock comprising a multilayered fabric receptacle dimensioned to fit over the foot and at least a portion of the leg of the wearer, said method comprising the steps of:

(a) knitting an inner fabric layer of the receptacle;

(b) knitting an outer fabric layer of the receptacle;

(c) sewing an opening in one of the fabric layers closed so as to present a closure seam in the one fabric layer;

(d) orienting the rib presented by the closure seam toward the other layer so that the rib is overlain and concealed by the other layer;

(e) sewing an opening in the other fabric layer closed so as to present a closure seam in the other fabric layer;

(f) orienting the rib presented by the closure seam in the other layer toward the one layer so that the rib is overlain and concealed by the one layer; and g) arranging the closure seams so that the ribs defined thereby are offset relative to one another.

12. A method as claimed in claim 11, step (d) including the step of positioning the inner layer within the outer layer.

13. A sock comprising:

a multilayered fabric receptacle dimensioned to fit over the foot and at least a portion of the leg of the wearer, said receptacle presenting a top, open leg end and an opposite toe end, said receptacle including substantially coextensive, separately knitted inner and outer layers, said inner and outer fabric layers presenting generally superimposed toe sections adjacent the toe end of the receptacle and dimensioned to fit over the toes of the wearer, generally superimposed leg sections adjacent the leg end of the receptacle and dimensioned to fit over at least a portion of the leg of the wearer, and generally superimposed foot sections each extending between the respective leg and toe sections, said inner and outer fabric layers being joined along the top end of the receptacle and at a location within the toe sections of the fabric layers, said inner and outer layers fabric layers being joined by sewn attachment stitches, said attachment stitches including a top stitching extending along the top end of the receptacle and a tack stitching located within the toe sections of the fabric layers.

14. A sock as claimed in claim 13, said top stitching comprising overlapping stitches.

15. A sock as claimed in claim 13, said top stitching extending completely around the top end of the receptacle.

16. A sock as claimed in claim 13, said tack stitching comprising a plurality of discrete stitchings spaced apart within the toe sections of the fabric layers.

17. A sock as claimed in claim 16, at least one of the fabric layers having a sewn closure seam extending across the toe section thereof, said tack stitching including discrete stitchings adjacent opposite ends of the closure seam.

18. A sock as claimed in claim 17, said tack stitching including another one of the discrete stitchings adjacent the toe end and spaced between the stitchings adjacent opposite ends of the closure seam.

19. A sock as claimed in claim 13, said tack stitching comprising an elongated stitching row, wherein the row is generally parallel to the toe end of the receptacle.

20. A method of making a sock, said method comprising the steps of:

(a) knitting an inner fabric layer;

(b) separately knitting an outer fabric layer substantially coextensive with the inner layer to cooperatively define a multilayered receptacle dimensioned to fit over the foot and at least a portion of the leg of the wearer;

(c) positioning the inner fabric layer within the outer fabric layer;

(d) joining the fabric layers to one another along a top, open leg end of the receptacle; and (e) joining the fabric layers to one another at a location within the generally superimposed toe sections of the layers, wherein the toe sections are adjacent a toe end of the receptacle and dimensioned to fit over the toes of the wearer.

21. A method as claimed in claim 20, steps (a) and (b) each including the steps of continuously knitting the toe section, a leg section adjacent the leg end of the receptacle, wherein the leg section is adjacent the leg end of the receptacle and dimensioned to fit over at least a portion of the leg of the wearer, and a foot section that extends between the leg and toe sections.

22. A method as claimed in claim 20; and (f) sewing an opening in one of the fabric layers closed so as to present a closure seam in the one fabric layer, step (c) including the step of orienting the rib presented by the closure seam toward the other layer so that the rib is overlain and concealed by the other layer.

23. A method as claimed in claim 20, step (d) and (e) each including the step of sewing attachment stitches.

24. A method as claimed in claim 23, step (d) including the step of sewing overlapping stitching along the leg end of the receptacle.

25. A method as claimed in claim 24, step (d) including the step of sewing the overlapping stitching completely around the leg end of the receptacle.

26. A method as claimed in claim 23, step (e) including the step of sewing a plurality of discrete stitchings spaced apart within the toe sections of the fabric layers.

27. A method as claimed in claim 26; and (f) sewing an toe opening in one of the fabric layers closed so as to present a toe closure seam extending across the toe section of the one fabric layer, step (e) including the step of sewing discrete stitchings adjacent opposite ends of the closure seam.

28. A method as claimed in claim 27, step (e) including the step of sewing another one of the discrete stitchings adjacent the toe end and spaced between the stitchings adjacent opposite ends of the closure seam.

29. A method as claimed in claim 23, step (e) including the step of sewing a stitching row generally parallel to the toe end of the receptacle.

* * * * *